US006966390B2

(12) United States Patent
Campling

(10) Patent No.: US 6,966,390 B2
(45) Date of Patent: Nov. 22, 2005

(54) PILE HAMMER

(75) Inventor: Barry Campling, East Yorkshire (GB)

(73) Assignee: Baca Limited, East Yorkshire (GB)

( * ) Notice: Subject to any disclaimer, the term of this patent is extended or adjusted under 35 U.S.C. 154(b) by 0 days.

(21) Appl. No.: 10/476,552

(22) PCT Filed: May 10, 2002

(86) PCT No.: PCT/GB02/02084

§ 371 (c)(1),
(2), (4) Date: Apr. 16, 2004

(87) PCT Pub. No.: WO02/092920

PCT Pub. Date: Nov. 21, 2002

(65) Prior Publication Data

US 2004/0159450 A1 Aug. 19, 2004

(30) Foreign Application Priority Data

May 12, 2001 (GB) ..... 0111604

(51) Int. Cl.[7] ..... B25D 17/00

(52) U.S. Cl. ..... 173/202; 173/115; 173/118; 173/90

(58) Field of Search ..... 173/90, 118, 202, 173/120, 121, 100, 210, 211, 203, 115

(56) References Cited

U.S. PATENT DOCUMENTS

| | | | | |
|---|---|---|---|---|
| 2,455,270 A | * | 11/1948 | Valentine | 173/120 |
| 2,559,478 A | * | 7/1951 | Stone | 173/202 |
| 2,787,123 A | | 4/1957 | Delvaux | |
| 3,039,546 A | | 6/1962 | Janson et al. | |
| 3,385,380 A | * | 5/1968 | Waller | 173/202 |
| 3,762,484 A | * | 10/1973 | Speicher | 173/202 |
| 4,247,149 A | | 1/1981 | Livesay | |
| 4,359,890 A | * | 11/1982 | Coelus | 73/12.13 |
| 4,506,744 A | | 3/1985 | Dawson | |
| 4,533,077 A | * | 8/1985 | Jochum | 227/156 |
| 4,844,661 A | | 7/1989 | Martin et al. | |
| 4,850,437 A | * | 7/1989 | Sudnishnikov et al. | 173/13 |
| 5,445,227 A | | 8/1995 | Heppner | |
| 6,000,477 A | * | 12/1999 | Campling et al. | 173/100 |

FOREIGN PATENT DOCUMENTS

| | | |
|---|---|---|
| EP | 0 389 956 A1 | 10/1990 |
| EP | 0 708 864 B1 | 9/1999 |

* cited by examiner

*Primary Examiner*—John Sipos
*Assistant Examiner*—Michelle Lopez
(74) *Attorney, Agent, or Firm*—Jenkins, Wilson & Taylor, P.A.

(57) ABSTRACT

A power tool (1) has a percussive driving implement for driving an impact tool (8). The driving implement, which may be hydraulic or pneumatic, retracts the impact tool (8) on its return stroke, against the force developed by heavy-duty elastic ropes (24). During the impact stroke the impact tool (8) is urged downwardly by the elastic ropes and, if the tool is upright, by gravity. At the start of the impact stroke the ram (10) is uncoupled by a ball clutch. At the beginning of the return stroke the ball clutch acts to couple the ram once again to the weight (20) and impact tool (8), in order to lift these to the retracted position. The uncoupling of the ram for the impact stroke reduces the loss arising from the resistance of the ram.

9 Claims, 2 Drawing Sheets

PILE HAMMER

DESCRIPTION

TECHNICAL FIELD

This invention relates to a power tool in which a body cycles between an impact position in which it transfers energy to a workpiece and a retracted position. The body may move from the retracted to the impact position under the force of gravity and/or under another force, for example a spring force.

BACKGROUND ART

Typically the body is moved from the impact position to the retracted position by a hydraulic ram, against the force of gravity and/or against another force. Such a device is described in EP 708864A. In the device of this specification hydraulic rams lift a body, against the force of gravity and against the force provided by two elastic ropes, to the retracted position, maximally removed from the impact position. When the retracted position is reached a magnetic sensor triggers the disconnection of the feed of hydraulic fluid to the cylinders of the rams and the body accelerates to the impact position, under its own weight and the spring force.

This method is effective but there is loss arising from the hydraulic resistance of the hydraulic rams, as the body moves from the retracted position to the impact position. Although the cylinders are no longer subject to pressurised fluid they do not easily vent their contents rapidly as the body falls. As well as causing loss of power the heat generated in the hydraulic cylinders and associated control circuits can be considerable and could lead to leakage, and early failure.

SUMMARY OF THE INVENTION

In accordance with a first aspect of the present invention there is provided a power tool having hydraulic or pneumatic means for moving a body from an impact position in which the body transfers energy to a workpiece and a retracted position maximally removed from the impact position, wherein the body moves from the impact position to the retracted position ("the return stroke") under the action of the hydraulic or pneumatic means and against the force developed by one or more elastic ropes, and wherein the body is urged by the elastic rope(s) from its retracted position to its impact position ("the impact stroke") whilst uncoupled from the hydraulic or pneumatic means.

Hereinafter the movement of the body from the impact position to the retracted position is called "the return stroke" and the second movement of the body from the retracted position to the impact position is called "the impact stroke".

When we state that during the impact stroke the body is uncoupled from the hydraulic or pneumatic means we do not mean that it must be mechanically disconnected from it. Rather, we mean that it is functionally decoupled from the hydraulic or pneumatic means. In other words, the hydraulic or pneumatic means has no or insignificant influence on the impact stroke. An analogy is with a clutch which acts to functionally decouple an engine from a gearbox.

Preferably the power tool has hydraulic means for moving the body from its impact position to its retracted position.

Suitably at least 50%, preferably at least 65%, and most preferably at least 75%, of the energy transferred by the body to the workpiece is provided by the elastic rope(s).

Thus, the power tool is preferably effective in uses when it is not vertically oriented with the body arranged to fall; for example when it is horizontally oriented. Of course, when held in an upright, suitably vertical, orientation with the body arranged to fall to the impact position—as would often be the case—an additional force to that developed by the elastic rope(s) is that of gravity. Suitably the body is a heavy weight.

Preferably a plurality of elastic ropes is used, most preferably two, arranged in diametrically opposed positions about the body.

Typically, the or each rope will comprise a plurality of linear untwisted individual strands of a suitable elastomer or a mixture of strands of different polymers. The rope formed from the individual elastic strands can be sheathed in a sheath to form a coherent structure to the rope and to reduce damage to the strands due to abrasion and/or contact with hydraulic fluids or the like. Preferably, such sheath is in the form of a braided relatively inextensible textile yarn which is applied, for example by means of a conventional braiding machine, to form a close fitting sheath upon the elastic strands whilst they are held in an extended condition. Typically, this extension is from 40 to 200% of the untensioned state of the elastic strands before they enter the braiding process. Upon relaxation of the tension on the internal structure of the rope, the close fit of the sheath upon the elastic strands prevents total retraction of the elastic strands. Typically, the elastic strands are held by the protective sheath in an extension of from 25 to 150%, notably from 40 to 100%, beyond its untensioned length. Typically, such ropes are made according to British Standards (Aerospace Series) Specification No BS 3F70:1991 and are commercially available for use, for example, in the arrester mechanism for aircraft on aircraft carrier landing decks.

Preferably, the polymers for present use are those which exhibit strain crystallisation under tension, since we have found that such polymers provide prolonged life during use. Typical of such polymers are natural and synthetic rubbers, notably polyisoprene, polychloroprene and poly(cis) isoprene rubbers; butadiene and styrene-butadiene rubbers; polyurethene rubbers; polyalkylene rubbers, for example isobutylene, ethylene or polypropylene rubbers; polysulphone, polyacrylate, perfluoro rubbers; and halogenated derivatives and alloys or blends of such rubbers. The use of natural rubber, chloroprene or synthetic isoprene rubbers is especially preferred.

Preferably the hydraulic or pneumatic means is a ram and the distal end of the piston thereof has a clutch mechanism for selectively engaging with the body. Between the impact position and retracted position the clutch mechanism acts to engage the body, so that the piston carries with it the body. At the retracted position the clutch mechanism acts to uncouple the body, permitting it to move towards the workpiece, substantially without hindrance from the piston. At the impact position the clutch mechanism acts once more to couple the body to the piston.

Preferably the clutch mechanism is a ball clutch in which the radial position of balls determines whether the body is coupled to the piston. Suitably the body has an internal chamber within which the piston is located. The distal end of the piston preferably carries a ring part, through the thickness of which is mounted a plurality of balls. The inside wall of the chamber of the weight has an annular groove at a position generally distant from the cylinder of the ram. When the body is coupled to the piston the balls are urged, for example by a spring force, to an outermost position, partially within the annular groove. At the retracted position the clutch operates so that the balls leave the annular groove in the internal chamber of the body, freeing the body to move to the impact position. To this end there may be a second ring inside the ring which carries the balls. This second ring has an annular groove. During the return stroke this inner annular ring is not aligned with the balls. At the retracted position this inner annular ring moves, so that its groove is aligned with the balls. The arrangement is such that the balls move radially inwardly, into this groove, and disengaging from the annular groove in the internal chamber of the body.

In another embodiment the body has a cavity and inside the cavity there is a hose for pressurised fluid. When the hose is pressurised it expands to grip the inside of the body, and can then lift the body. At the retracted position the hose is vented and is uncoupled from the body, virtually instantaneously, such that the body can move to the impact position without any constraint, from the hose.

In accordance with a further aspect of the present invention there is provided a method of applying a percussive force to an object, using a power tool of the first aspect of the invention. Preferably the power tool can operate effectively in any position, during the method.

BRIEF DESCRIPTION OF THE DRAWINGS

The invention will now be further described, by way of example, with reference to the accompanying drawings, in which

FIG. 2 shows its clutch mechanism in greater detail; in upper longitudinal cross section.

DETAILED DESCRIPTION OF THE INVENTION

Figure 1:
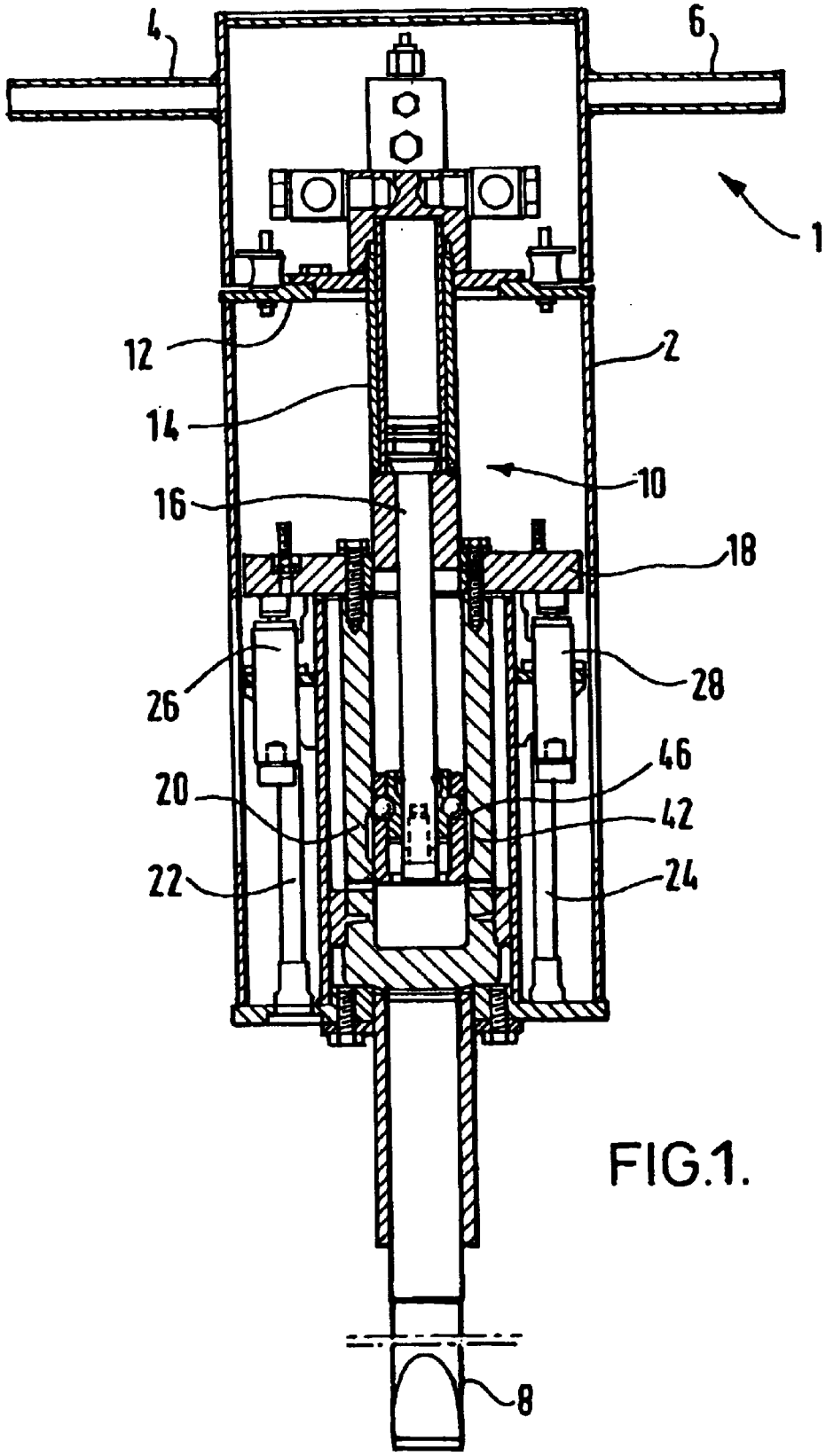
FIG. 1 shows a jack hammer in accordance with the invention, in longitudinal cross section.

The jack hammer 1 comprises a casing 2 carrying upper handles 4, 6, and a workpiece in the form of a chisel 8. Inside the casing 2 there is a hydraulic ram 10 mounted through a platform 12. The ram comprises a cylinder 14 and a piston 16. Mounted onto a moving platform 18 there is a body 20 in the form of a heavy weight or tup. Mounted between the moving platform and the bottom wall of the jack hammer are two elastic ropes 22, 24, each having an in-line shock absorber 26, 28. The jack hammer is shown in a vertical orientation with the chisel lowermost, the most common in-use orientation.

The ropes are high-duty high energy-storage ropes. Each rope is made up of several hundred strands per cross-section of natural rubber, able to undergo strain crystallisation.

An inelastic textile braid is provided as a sheath around the strands. This is fitted with the rope in an extended condition, and is such that the rope cannot relax to its untensioned condition. Rather, it is held by the braid at an extension of 60% beyond its untensioned length.

In the operation of the jack hammer the body 20 is lifted, against the force of gravity and against the tensile force developed by the elastic ropes 22, 24. At a defined point the body is permitted to move from its retracted position to its impact position in which it strikes the chisel 8. We have determined that when the jack hammer is upright with the chisel lowermost approximately 75% of the energy transferred to the chisel comes from the elastic ropes and approximately 25% comes from gravity.

The invention concerns the manner in which the body is reciprocated, under the action of the ram.

The ram 10 is wholly responsible for moving the body 20 from its impact position to its retracted position.

The body has a cylindrical bore and the distal end of the piston is within this bore.

Figure 2:
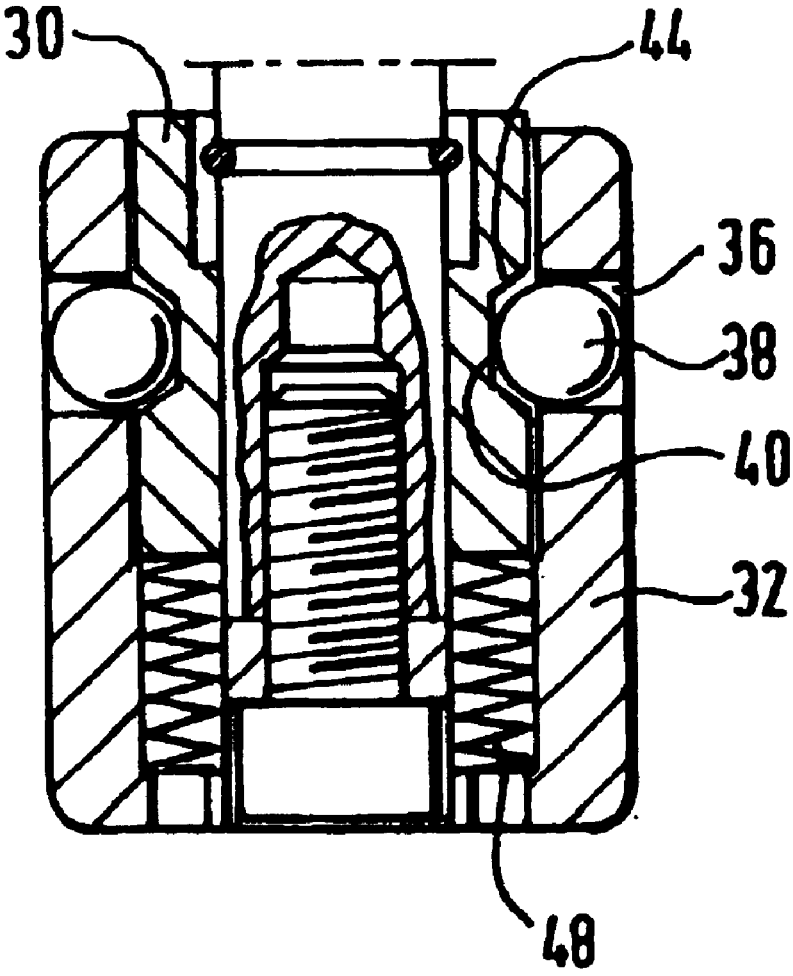
FIG. 2 is a more detailed cross sectional view of the distal end of the piston of the jack hammer.

The distal end of the piston 16 carries an inner sleeve 30, and an outer sleeve 32 (see FIG. 2). The outer sleeve rests lightly against the surface of the bore formed inside the body. The outer sleeve 32 has four through apertures containing respective steel balls 38. The outer face of the inner sleeve 30 has a narrow groove 40 able to receive the balls. The length of this groove in the axial direction is approximately the ball diameter.

Towards the end of the bore which is away from the cylinder 14 the bore is formed with an annular groove 42, whose length in the axial direction is several times the ball diameter.

The grooves within the outer surface of the inner sleeve and within the bore of the weight both have chamfered lead-ins 44, 46.

The inner sleeve 30 is always urged upwards, relative to the outer sleeve 32, by means of four springs 48 set between the bottom of the inner sleeve 30 and the end of the outer sleeve 32 (see FIG. 2; not shown in FIG. 1).

The parts described function as an effective and simple clutch, whereby the ram moves the weight to its retracted position and is then functionally decoupled from it, so that it can move to its impact position without any restraint. The way this is achieved will now be described.

In FIG. 1 the weight is shown after it has reached the impact position. The balls 38 are just above the annular groove 42 in the bore of the body. When they reach alignment with that groove the springs 48 which are constantly urging the inner sleeve upwards, cause the balls to move outwards, into the groove 42. Now that the balls are partly within that groove 42 the inner sleeve is free to rise somewhat, relative to the outer sleeve 32, under the influence of the springs, so that the groove 40 of the inner sleeve is no longer lined up with the through holes 36 within the outer sleeve, for the balls. Instead, a plain wall portion of the inner sleeve is lined up with the through holes. Therefore, the balls have to remain partly within the groove 42 in the body. The piston is retracted into the cylinder and the body must follow the movement of the piston.

It will be seen that the top of the inner sleeve projects somewhat above the top of the outer sleeve. It does this already in the FIG. 1 arrangement, and does so to a greater extent during the return stroke.

As the piston reaches its retracted position the inner sleeve strikes an end stop such as the end of the cylinder and its groove 40 is once again lined up with the through holes 36. The balls move inwards and come to nest in the inner groove 40 and thus are no longer in the outer groove 42. The body is free to move to the impact position, without constraint arising from the hydraulic ram The piston 16 is subsequently extended until, once more, the balls line up with the outer groove 28, the springs 38 urge the inner sleeve upwardly and, thus, the piston and the body are coupled together, such that the piston can lift the body.

When the power tool is required to be used in other orientations the energy contribution from the gravity component may be reduced (oblique downward orientations), removed (horizontal orientations) or even be a negative value (oblique upward or inverted orientations) but the energy transferred by the ropes is ample to provide effective percussive action.

What is claimed is:

1. A power tool having hydraulic or pneumatic means for moving a body from an impact position in which the body transfers energy to a workpiece and a retracted position maximally removed from the impact position, wherein the power tool has a clutch mechanism for coupling the body to the hydraulic or pneumatic means, wherein the body moves from the impact position to the retracted position under the action of the hydraulic or pneumatic means and against the force developed by elastic ropes while coupled to the hydraulic or pneumatic means by the clutch, and wherein the body is urged by the elastic ropes from its retracted position to its impact position while uncoupled from the hydraulic or pneumatic means by the clutch, wherein the body has an internal chamber within which the clutch mechanism engages.

2. A power tool as claimed in claim 1, wherein at least 50% of the energy transferred by the body to the workpiece is provided by the elastic ropes.

3. A power tool as claimed in claim 2, wherein at least 75% of the energy transferred by the body to the workpiece is provided by the elastic ropes.

4. A power tool as claimed in claim 1, having hydraulic means for moving the body from its impact position to its retracted position.

5. A power tool according to claim 1, wherein the body is a heavy weight.

6. A power tool according to claim 1, wherein the hydraulic or pneumatic means is a ram with a piston, including a proximal end and a distal end, and the distal end of the piston thereof has a clutch mechanism for selectively engaging with the body, and arranged such that:

(a) during the return stroke the clutch mechanism acts to couple the body to the piston, so that the piston carries with it the body; and (b) at the retracted position the clutch mechanism acts to uncouple the body from the piston, permitting it to move on its impact stroke substantially without hindrance from the piston;

(c) at the impact position the clutch mechanism acts once more to couple the body to the piston.

7. A power tool according to claim 6, wherein the clutch mechanism is a ball clutch in which the radial position of balls determines whether the body is coupled to the piston.

8. A method of applying a percussive force to an object, using a power tool as claimed in claim 1.

9. A method as claimed in claim 8, wherein the power tool can operate effectively in any position.

* * * * *